US009721450B2

(12) United States Patent
Kumar

(10) Patent No.: US 9,721,450 B2
(45) Date of Patent: Aug. 1, 2017

(54) WEARABLE REPETITIVE BEHAVIOR AWARENESS DEVICE AND METHOD

(71) Applicant: Sameer A. Kumar, Minneapolis, MN (US)

(72) Inventor: Sameer A. Kumar, Minneapolis, MN (US)

( * ) Notice: Subject to any disclaimer, the term of this patent is extended or adjusted under 35 U.S.C. 154(b) by 0 days.

(21) Appl. No.: 15/051,026

(22) Filed: Feb. 23, 2016

(65) Prior Publication Data

US 2016/0247380 A1 Aug. 25, 2016

Related U.S. Application Data

(60) Provisional application No. 62/120,472, filed on Feb. 25, 2015.

(51) Int. Cl.
*G08B 21/24* (2006.01)
*G08B 21/04* (2006.01)

(52) U.S. Cl.
CPC ..... *G08B 21/24* (2013.01); *G08B 21/0407* (2013.01); *G08B 21/0415* (2013.01)

(58) Field of Classification Search
CPC ..... G08B 21/0407; G08B 21/0415; G08B 21/0423; G08B 21/043; G08B 21/0438; G08B 21/0446; G08B 21/0453; A61B 5/11; A61B 5/1107; A61B 5/1116; A61B 5/1118; A61B 5/1123
See application file for complete search history.

(56) References Cited

U.S. PATENT DOCUMENTS

2009/0264711 A1* 10/2009 Schuler ..... A61B 5/16 600/300
2014/0335490 A1* 11/2014 Baarman ..... A61B 5/002 434/236
2015/0164377 A1* 6/2015 Nathan ..... A61B 5/1122 600/595
2015/0302310 A1* 10/2015 Wernevi ..... G06F 19/345 706/12

* cited by examiner

*Primary Examiner* — Van Trieu
(74) *Attorney, Agent, or Firm* — Briggs and Morgan, P.A.; Daniel A. Rosenberg

(57) ABSTRACT

The present invention relates generally to an awareness enhancement apparatus and method for undesirable repeated behaviors, including but not limited to obsessive compulsive and related disorders, and most relevant to trichotillomania (hair pulling), onychophagia (nail biting), dermatillomania (skin picking) and thumb sucking, among others. More particularly, the invention relates to a sensing and feedback device and associated methods of use which indicates a behavior based on the user's physical gestures and positioning of the hands, these gestures and positions being related to these undesirable behaviors typical of such disorders and alerting the user so that he or she can reduce the behavior.

24 Claims, 3 Drawing Sheets

WEARABLE REPETITIVE BEHAVIOR AWARENESS DEVICE AND METHOD

RELATED APPLICATIONS

The present invention incorporates by reference and claims priority to U.S. Provisional Patent Application No. 62/120,472 filed on Feb. 25, 2015.

BACKGROUND

Field of the Invention

The present invention relates generally to an awareness enhancement apparatus and method for undesirable repeated behaviors, including but not limited to obsessive compulsive and related disorders, and most relevant to trichotillomania (hair pulling), onychophagia (nail biting), dermatillomania (skin picking) and thumb sucking, among others. More particularly, the invention relates to a sensing and feedback device and associated methods of use which indicates a behavior based on the user's physical gestures and positioning of the hands, these gestures and positions being related to these undesirable behaviors typical of such disorders and alerting the user so that he or she can reduce the behavior.

Background Description of the Related Art

Nervous behaviors such as trichotillomania (hair pulling), onycophagia (nail biting), dermatillomania (skin picking), thumb sucking and others might be labeled dismissively as "bad habits" and are often harmless for the majority of the affected population. There is, however, increasing focus in the medical community on the group of people for whom these behaviors have significant negative psychological or physical consequences. These specific problematic subtype of behaviors are called body focused repetitive behaviors (BFRBs), which is an umbrella term used to describe certain obsessive compulsive and related behaviors that cause damage to one's body or physical appearance. The prevalence rate of BFRBs has been difficult to determine due to being a poorly understood condition from a scientific perspective and often involving individuals who are attempting to hide their condition(s) or who are not consciously aware of when they are engaging in such behavior. Nevertheless, one study in 2002 of 454 university students reported prevalence rate of BFRBs at 13.7% of the population (Teng, Woods, et al.).

Trichotillomania is one type of BFRB and is characterized by recurrent pulling of one's hair, resulting in hair loss. Reliable trichotillomania prevalence estimates suffer from the two problems of many BFRBs: the individuals that have it may attempt to hide the condition, and there have not been a wealth of academic studies. Nevertheless, the range of reported prevalence is between 0.6-4% (Huynh, Gavino) of the population. In individuals with trichotillomania, hair is most commonly pulled from the scalp, eyebrows and eyelashes but can be pulled from anywhere on the body. The patient may pull hair while being conscious of the action (focused pulling) or the action may be a subconscious behavior (unfocused pulling). When the person engages in focused pulling, he or she may feel an urge to pull from a particular area and feels relief once the hair is pulled. In unfocused pulling, the person may be unaware while he or she is pulling hair, and only become aware once he or she sees the pulled hairs or resulting bald spot. Persons with trichotillomania may suffer from distress due to negative social interactions including bullying and harassment from having thinning or baldness on the scalp, eyebrows, eyelashes or other areas. In spite of the distress caused by this condition, the urge to pull, whether focused or unfocused, can be difficult to overcome. Additionally, patients suffering from trichotillomania, in particular, but also other BFRBs often feel a sense of shame, embarrassment, anger or guilt stemming from their condition.

Individuals with BFRBs generally find methods of hiding their condition, and some may seek treatment. Common methods of hiding trichotillomania may include wigs, hats, eyebrow pencils, false eyelashes, or similar cosmetic approaches. The primary methods of treatment of BFRBs are Cognitive Behavior Therapy (CBT), supportive counseling, support groups, hypnosis, medications and combined approaches (Franklin, Zagrabbe). However, the scientific literature supporting the efficacy of these approaches is not well developed, with fewer than 20 randomized controlled trials available to guide treatment choice and implementation (Franklin, Zagrabbe). The current leading method for addressing BFRBs is Cognitive Behavioral Therapy (CBT), whereby individuals learn how to change their thoughts, feelings, and behaviors by working alongside a therapist or professionally trained psychologist. Studies have shown that, when followed through, CBT can be useful in managing and preventing a wide variety of mental disorders (Trich.org). However, relapse rates can be high once the patient stops CBT. Additionally, CBT is not available to everyone as not all psychologists have been trained in treating BFRBs, not all psychologists practice CBT, and this form of therapy can be prohibitively expensive for many individuals.

Other methods of preventing BFRBs and similar conditions have been presented using some form of physical restraints. U.S. Pat. No. 6,093,158 for example, is directed to a system for monitoring an undesirable behavior from the set of bruxism, jaw clenching, or snoring. The invention can use a variety of sensors, including those to monitor sound from the undesirable behaviors, signals from muscles in and around the mouth, or force on the teeth. The system described involves wearing an apparatus on the head to monitor the conditions, which is undesirable from a user's perspective due to the common desire to hide the condition via the use of discreet wearable apparatuses.

Another patent, U.S. Pat. No. 4,965,553 discusses a device to alert the user when the hand is near the mouth in order to aid in calorie counting. While it may be effective in reminding the user when that person is eating, eating is an action that is necessary for survival and therefore not always undesirable. Creating a negative feedback signal for an undesirable action can be a more effective system.

Finally, in U.S. Pat. No. 6,762,687, a system of alerting the user when he or she is performing certain obsessive-compulsive spectrum disorders, is described. The specific embodiments of the system are comprised of two pieces, a sensor worn on the head, neck or chest, as well as an element associated with the arm, hand, or finger. Such a system is overly cumbersome for the application of preventing a user from a behavior, and a system eliminating one of these pieces could be preferable to users seeking to keep the purpose of the apparatus discreet.

Thus, a need exists for a method and apparatus that can monitor, provide feedback about, and ultimately assist in controlling BFRBs that substantially eliminates the problems associated with the prior art.

SUMMARY OF THE INVENTION

In accordance with the present invention, the problem of having a discreet device that alerts the user when performing undesirable behaviors is solved by incorporating orientation and/or gesture recognition into a single device worn on the arm, wrist or hand.

Various objects, features, aspects, and advantages of the present invention will become more apparent from the following detailed description of preferred embodiments of the invention, along with the accompanying drawings in which like numerals represent like components.

DETAILED DESCRIPTION OF THE PREFERRED EMBODIMENTS

Figure 1:
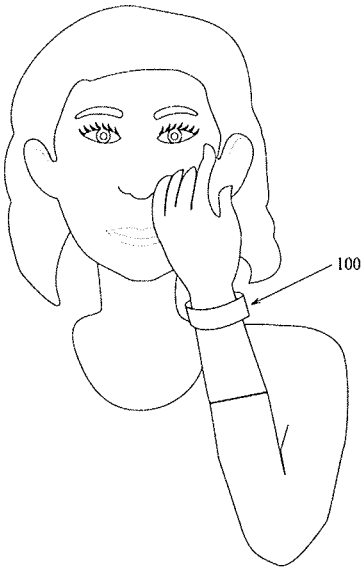
FIG. 1 is a drawing of an individual equipped with apparatus according to this invention.
Figure 2:
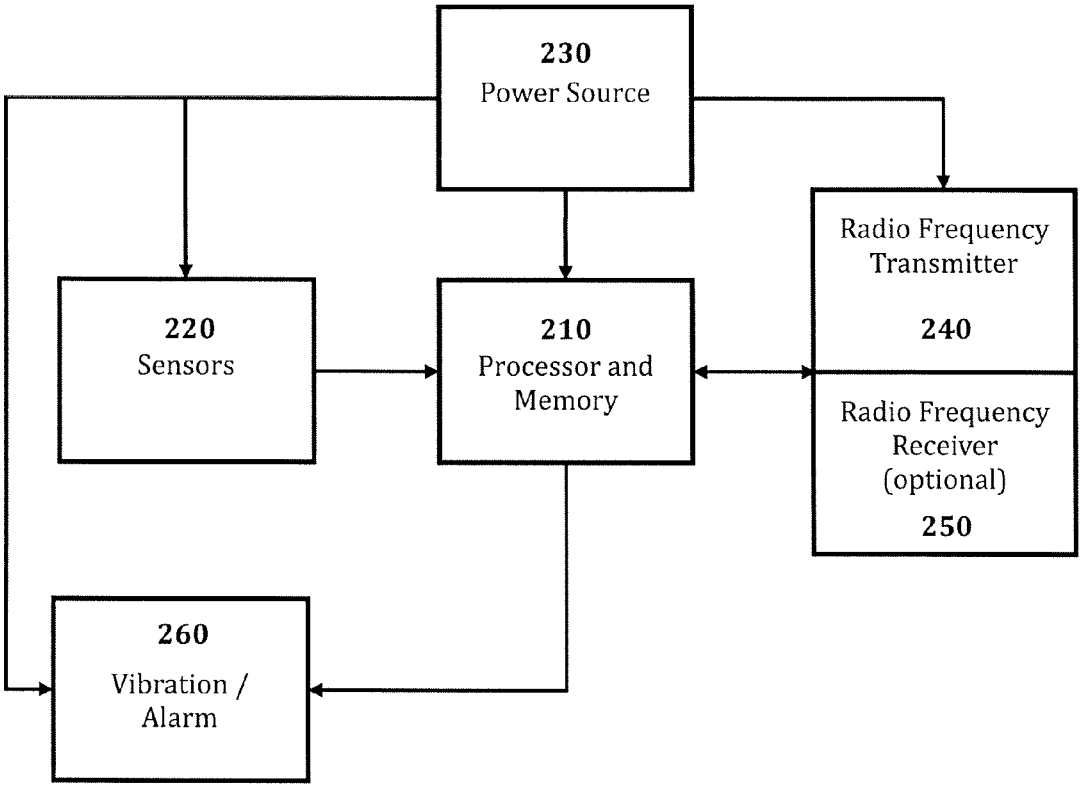
FIG. 2 is a simplified block diagram of the electronic circuitry applicable to the invention.

Referring to FIG. 1, a wearable repetitive behavior awareness device 100 is shown in the form of a wrist-band, which includes the components mentioned in FIG. 2. The wearable repetitive behavior awareness device 100 includes a processor and memory 210, sensors 220 (including an inertial measurement unit (IMU) comprised of an accelerometer, gyroscope, and optionally a magnetometer, and may include biofeedback sensors measuring heart rate, skin electrical activity, or other physiological activity), a power source 230, a radio frequency transmitter 240, a radio frequency receiver 250, and a vibration motor or some other real-time tactile, auditory or visual signal 260 to indicate that the bad habit or undesirable behavior has been detected and is occurring.

FIG. 1 shows a user wearing the repetitive behavior awareness device 100 that alerts the user when he or she is performing the undesirable behavior by a tactile, auditory or visual signal. In the preferred embodiment, the alarm is a tactile sensation, such as a vibration, which will allow the device to remain discreet. The device can be trained to actuate the tactile sensation when the user performs a custom gesture or hand orientation associated with a BFRB, and can also come pre-programmed for specific pre-defined common physical gestures and orientations, such as raising the hand to the face and keeping it there.

In a preferred embodiment, the wearable repetitive behavior device is a discreet wrist-worn or hand-worn band, which may have the appearance of a common fitness band or piece of jewelry such as a bracelet or ring. The device sensor unit is an inertial measurement unit accelerometer, gyroscope, and a magnetometer, for optimal hand orientation and gesture recognition. Use of specific biofeedback sensors such as heart rate monitoring and/or skin electrical activity could further augment the accuracy of the device by corroborating biofeedback signals with the inertial measurement unit's readings of orientation and gesture.

The device could be worn on one arm, wrist or hand, and a device with similar functionality (but potentially a different form factor) could be worn on the opposing arm, wrist or hand. This way the user could monitor undesirable behaviors that occur with both hands, as most people with BFRBs and similar conditions use both hands to perform the behavior. The devices are both connected to a single mobile device (e.g. smartphone) via the radio frequency transmitter.

Example Use Case

In the case of an individual with trichotillomania who pulls from the eyebrows and eyelashes, the device worn on both wrists would help him or her become more aware of the act of pulling, whenever the algorithm on the device detects the undesired behavior. The user has the option of using the algorithms already programmed on the device (e.g. for common undesirable movements), or can train the algorithm to detect a custom behavior. If the user chooses to train the algorithm, he or she would do so by performing the behavior and giving feedback (details below) so as to minimize the occurrence of false positives (instances when the alarm is actuated but the behavior performed is benign) as well as false negatives (instances when the alarm is not actuated in spite of the undesirable behavior having been performed). Once the algorithm has been trained, the user could wear the device to alert him or her when the hands have moved to the face and are near the eyebrows/eyelashes.

Figure 3:
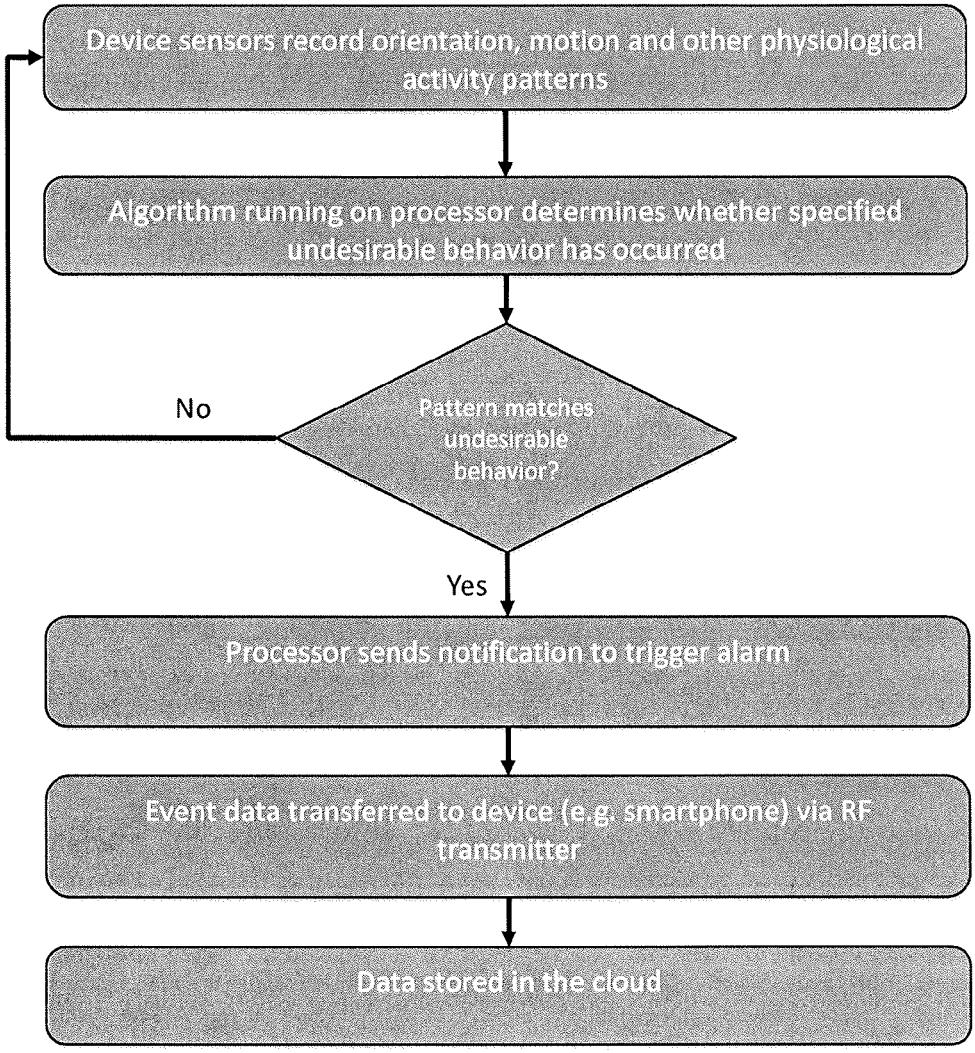
FIG. 3 is a flowchart showing the action of the system when in use.

The device would then work as described in the system flowchart (FIG. 3). The device sensors would record the motion and orientation, and intermittently check if the motion pattern or orientation reading matches that of the trained algorithm. If the processor determines there is a match, then the processor would trigger the alarm, which would preferably be a discreet tactile vibration. The device would record the time that the behavior had occurred and store it in the memory, and transmit the data when connected to the smartphone via the RF transmitter. Finally, the data would be stored in the cloud remotely from the phone for analysis and retrieval in the future.

The primary benefit of such a device is the real-time feedback via the alarm of the undesirable behavior occurring so that the user can stop him or herself prior to pulling the hair. Additionally, the device is unobtrusive and does not interfere with the user's appearance or normal movements, which would avoid calling attention to the user and the condition so as to increase compliance. Though it may help most during cases of unfocused (subconscious) pulling, the user may derive benefit in cases of focused (conscious) pulling as well because the alert prompts the user to reexamine his or her choice. Over time, and perhaps in conjunction with existing treatments including Cognitive Behavioral Therapy, the alerts from the device could help drive awareness of the behavior, identify the situations that trigger the behavior, and help the user develop strategies for reducing the behavior.

Sensor Functionality

The device sensor contains an inertial measurement unit (IMU), consisting of an accelerometer and a gyroscope, and optionally a magnetometer. The IMU can record specific force, angular rate, and optionally magnetic field data, which can be processed to determine whether a specific motion (i.e. gesture) or hand position (i.e. orientation) is occurring. This information can help the user because in order to perform a BFRB or related behavior, a hand reaches toward another body part such as the head or face. At the end state of this motion, such as in FIG. 1, the orientation of the arm changes and the force of gravity acts on the sensors in a specific and repeatable pattern that can be identified to trigger an alert. Finally, the addition of biofeedback sensors such as heart rate monitors and skin electrical activity sensors are useful to inform when a user is suffering from acute anxiety or stress, which can be correlated to BFRB activity. The additional biofeedback sensors improve the accuracy of the device, but are not necessary for the device to perform its basic function of gesture and orientation pattern recognition.

Actuating the Vibration

The device sensors 220 are connected to a processor 210 that is operative to generate an output signal in the event that the motion or hand orientation being performed by the user matches a particular pre-defined set of undesirable behaviors, which are determined by either the custom training process or a general set of gestures (e.g. raising the hand to the face). The apparatus further includes a device operative to alert the user in response to the output signal generated by the device sensors 220. The device operative to alert the user in response to the output signal generated by the device sensors produces an audible, visual or tactile vibration sensation. The sensor housing itself may produce the alert directly, or circuitry may be provided to produce a wireless signal to a separate unit operative to generate an audible, visual or tactile sensation.

Additionally, further functionality is provided to minimize false alarms including appropriate hand orientation and/or gesture recognition, physiological activity, time spent performing an appropriate gesture, contextual information (e.g. if the user is currently using a mobile device) or other behaviors that do not represent any of the undesirable behaviors. The system is also equipped with a manual user-operable override (see "Feedback Mechanisms" section below) to prevent the alarm from being activated for a predetermined period of time to permit acceptable activities (e.g. in the case of hair pulling, the user may want to override the alarm while he or she is eating, which may have a similar motion and hand orientation to hair pulling).

Training Algorithms

There are a number of different gestures associated with one or more undesirable behaviors that users may want to eliminate. For example, in the case of a user who has trichotillomania, the user can pull from the eyebrows and eyelashes or different areas of the scalp, which may likely have different motion patterns and positions of the hands associated with them. To achieve these goals, the user initially calibrates the device with his or her undesirable motions. The wearable repetitive behavior awareness device will record the data associated with the motions from the device sensors 220 and use that set of data so that the alarm (e.g. vibration motor) will be actuated whenever the user performs the custom motion. The device "gesture training" will impart the advantage of personal customization to detect the undesirable repetitive behaviors.

Mobile Interface—Mobile Phone App, Snooze

In a preferred embodiment, the wearable repetitive behavior awareness device pairs with a mobile device, such as a smartphone to provide the user with additional features and functionality. The features provided with the mobile application include data logging and tracking, amongst others. The user would be able to see data pertaining to their undesirable behavior(s) including when and how often they have performed the behaviors.

Feedback Mechanisms

The user is able to deliver feedback to the device directly, via either buttons or physical gestures, or indirectly via the mobile application.

In the direct feedback case, for example, after receiving an alert from the device due to an undesirable behavior detection, the user can confirm the correct reading from the device using a button or through the accelerometer by tapping the device in a predefined way (e.g. tapping twice). Alternatively, the user can inform the device that the behavior was benign by a similar mechanism.

In the indirect feedback case, the user confirms or rejects readings from the device via the mobile app. For example, the mobile app logs each instance that it registers the undesirable behavior with a timestamp, and the user may confirm or correct the readings through the mobile app.

While the preferred embodiment of the invention has been described in reference to the Figures, the invention is not so limited. For example, the device can be used without an alarm feature. In some applications it may be desirable to simply collect information associated with a behavior to determine if a particular treatment has helped, or if the behavior has worsened or improved over time. Thus, the alarm can be turned on or off as needed to both alert the user, and/or merely allow the device to collect information.

Further, the device can be used as a positive feedback device. For example, in the case of BFRBs the device can detect periods when the behavior is absent and emit an alert (such as a pleasant tone) that may assist the user in understanding when the behavior is not occurring, or as a reward.

Further, the device can be used as a feedback mechanism for any physical bad habit that the user may want to track or reduce, which may or may not be classified as BFRBs. Some examples of such habits could be smoking, overeating, or hair twirling. Still further, the device can be used in connection with behaviors that may be repetitive but not necessarily harmful or undesirable. These could be precursor behaviors associated with the onset of BFRBs. Or, the behaviors monitored could have nothing to do with disorders but instead the device could monitor body position relationships that may be positive or negative to a user in the field of sports, ergonomics, and the like.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A repetitive behavior awareness method, comprising:

providing a behavior awareness device comprising a computer processor, a computer memory, sensors for detecting user movements;

programing the device to detect a localized repetitive behavior by having the user repeat the behavior while the device is in a training mode where the device stores an electronic representation of the behavior in the memory; and monitoring a user with the device to determine if the programmed behavior is present by using an algorithm stored in the device to compare user behavior to the behavior stored in the device during training.

2. The method of claim 1 wherein the sensor comprises one or more of the following an accelerometer, gyroscope, or magnetometer.

3. The method of claim 1 further comprising the steps of sensing the user's physiological activity and correlating the activity to the behavior.

4. The method of claim 3 wherein the physiological activity includes heart rate or skin electrical activity.

5. The method of claim 1 wherein the device is worn on the wrist of the user.

6. The method of claim 1 further providing a second device, wherein the second device is programed to detect the behavior, and monitors the user to determine if the programmed behavior is present.

7. The method of claim 6 wherein each device is worn on the user's wrist.

8. The method of claim 1 further comprising the step of alerting the user with an alarm if the behavior is present.

9. The method of claim 8 wherein the device further comprises a vibration motor which is used to provide the alert.

10. The method of claim 8 wherein the alert can be overridden during periods where benign movements can mimic the behavior.

11. The method of claim 1 wherein the behavior is a body focused repetitive behavior.

12. The method of claim 1 further comprising the step of training the device to distinguish between the behavior and other benign activities.

13. The method of claim 1 further providing a remote computing device interfaced with the device for storing information collected during the monitoring step.

14. The method of claim 13 wherein the device communicates with the smart phone via an RF transmitter.

15. The method of claim 14 where the remote computing device is used to perform behavior tracking.

16. The method of claim 14 where the remote computing device is a smart phone.

17. The method of claim 1 further comprising the step of detecting periods where the behavior is not present.

18. The method of claim 1 where the device is worn on the user's appendage.

19. The method of claim 1 where the device notifies the user if the behavior is not present for a predetermined period of time.

20. A repetitive behavior awareness method, comprising:

providing two behavior awareness devices attached to a user's wrists each device comprising a computer processor, a computer memory, and sensors which detect body movement and physiological conditions associated with a body focused repetitive behavior;

programing the device to detect a localized repetitive behavior;

training the device to distinguish between the behavior and other activities by having the user repeat the behavior while the device is in a training mode where the device stores an electronic representation of the behavior in the memory;

monitoring the user with the device to determine if the programmed behavior is present using the sensors;

performing an algorithm on the processor to determine if the movements indicate the presence of the behavior by using the algorithm stored in the device to compare the sensed user behavior to the behavior stored in the device during training; and altering the user with an alarm if the behavior is present.

21. The method of claim 17 where the behavior is trichotillomania.

22. The method of claim 17 where the behavior is onychophagia.

23. The method of claim 17 where the behavior is dermatillomania.

24. The method of claim 17 where the behavior is finger or thumb sucking.

* * * * *